US006011851A

United States Patent [19]

Connor et al.

[11] Patent Number: 6,011,851

[45] Date of Patent: Jan. 4, 2000

[54] SPATIAL AUDIO PROCESSING METHOD AND APPARATUS FOR CONTEXT SWITCHING BETWEEN TELEPHONY APPLICATIONS

[75] Inventors: Kevin J. Connor, Sunnyvale; Michael E. Knappe, San Jose, both of Calif.; David R. Oran, Acton, Mass.

[73] Assignee: Cisco Technology, Inc., San Jose, Calif.

[21] Appl. No.: 08/880,484

[22] Filed: Jun. 23, 1997

[51] Int. Cl.[7] ..... H04R 5/00

[52] U.S. Cl. ..... 381/17; 379/202; 381/61

[58] Field of Search ..... 381/17, 18, 1, 381/61, 63; 379/202–206; 370/266, 260, 265

[56] References Cited

U.S. PATENT DOCUMENTS 4,506,358 3/1985 Montgomery .
4,734,934 3/1988 Boggs et al. ..... 379/202
5,027,689 7/1991 Fujimori ..... 84/622
5,212,733 5/1993 DeVitt et al. ..... 381/119
5,440,639 8/1995 Suzuki et al. ..... 381/17
5,521,981 5/1996 Gehring ..... 381/26
5,734,724 3/1998 Kinoshita et al. ..... 381/17

*Primary Examiner*—Ping Lee
*Attorney, Agent, or Firm*—Marger Johnson & McCollom

[57] ABSTRACT

Multiple audio streams are spatially separated with a context switching system to allow a listener to mentally focus on individual point sources of auditory information in the presence of other sound sources. The switching system simultaneously directs incoming sound sources to different spatial processors. Each spatial processor moves the received sound sources to different audibly perceived point sources. The outputs from the spatial processors are mixed into a stereo signal with left and right outputs and then output to the listener. Important sound sources are moved to a foreground point source for increased intelligibility while less important source sources are moved to a background point source.

17 Claims, 4 Drawing Sheets

| CONTROL POSITION | SOUND SOURCE | SPATIAL PROCESSOR DESTINATIONS |
|---|---|---|
| 1 | 1 | BACK/LEFT PROCESSOR |
| | 2 | FRONT/CENTRE PROCESSOR |
| | 3 | BACK/RIGHT PROCESSOR |
| 2 | 1 | FRONT/CENTRE PROCESSOR |
| | 2 | BACK/LEFT PROCESSOR |
| | 3 | BACK/RIGHT PROCESSOR |
| 3 | 1 | BACK/LEFT PROCESSOR |
| | 2 | BACK/RIGHT PROCESSOR |
| | 3 | FRONT/CENTRE PROCESSOR |

SPATIAL AUDIO PROCESSING METHOD AND APPARATUS FOR CONTEXT SWITCHING BETWEEN TELEPHONY APPLICATIONS

BACKGROUND OF THE INVENTION

This invention relates to audio signal processing and more particularly to incorporating different spatial characteristics into multiple independent audio signals.

Context switching in telephony applications traditionally comprises multiple telephone lines that are output to a desktop telephone handset. The context switch allows a phone user to selectively listen to one active telephone line and put any number of additional active telephone lines in a "hold" state. Thus, the telephony applications, such as voice mail, are presented to a user in an audibly mutually exclusive fashion that prohibits simultaneous presentation of other auditory inputs to the phone user.

Conferencing features sum together incoming line appearances to an end user. However, the conferencing feature also allows each line appearance to monitor the sum of all other conferenced appearances, which may not be desired. The conferencing features traditionally offered in telephony products are monaural and mix the incoming sound sources into a single point source. A point source is defined as a spatial location where one or more sound sources are audibly perceived as coming from. For example, when listening to an orchestra, the different musical instruments are each audibly perceived as coming from different point sources. Conversely, when listening to a telephone conference call, the voices on the telephone lines are all perceived as coming from a common point source.

Since the sound sources in a telephone conference call appear to all come from a single point source, a listener has difficulty differentiating between the incoming sources. Techniques which employ stereo presentation for conference calling do not allow the user to move incoming sound sources into perceptibly different foreground and background sources. Since each sound source appears to come from the same location, audio intelligibility for one specific sound source of interest is decreased when multiple sound sources are broadcast at the same time.

Accordingly, a need remains for an audio context switching system that improves the ability to monitor and differentiate multiple sound sources at the same time.

SUMMARY OF THE INVENTION

A spatial audio processing system exploits the natural ability of the human binaural auditory system to mentally focus on individual point sources of auditory information in the presence of other sound sources. A context switching system spatially separates multiple sound sources into different point sources so that a primary audio stream of interest can be easily differentiated from peripherally monitored audio streams of secondary interest.

The context switching system includes a switching circuit that simultaneously directs incoming sound sources to different spatial processors. The spatial processors each simulate a different spatial characteristic and together move the multiple sound sources to different audibly perceived point sources. A listener is then able to more effectively discriminate between the spatially separated sound sources when presented simultaneously.

The different spatial characteristics are generally categorized into either "foreground" or "background" priority. The source for which the listener requires the highest degree of intelligibility is assigned to the "foreground" position, which perceptually is centrally positioned closest to the listener and given highest magnitude playback levels. Incoming sources of lower listening priority are assigned to one of several "background" positions, which are perceptually located behind and either to the left or right of the "foreground" position and given lower magnitude playback levels.

Consumers of telephony products benefit from an increase in productivity by having the ability to switch context between applications whose primary user inputs are auditory while maintaining peripheral cognizance of multiple audio input streams. For example, a person on a long conference call who is no longer an active transmitting participant can listen to voice mail while continuing to monitor an ongoing discussion in the conference call.

The foregoing and other objects, features and advantages of the invention will become more readily apparent from the following detailed description of a preferred embodiment of the invention which proceeds with reference to the accompanying drawings.

DETAILED DESCRIPTION

Figure 1:
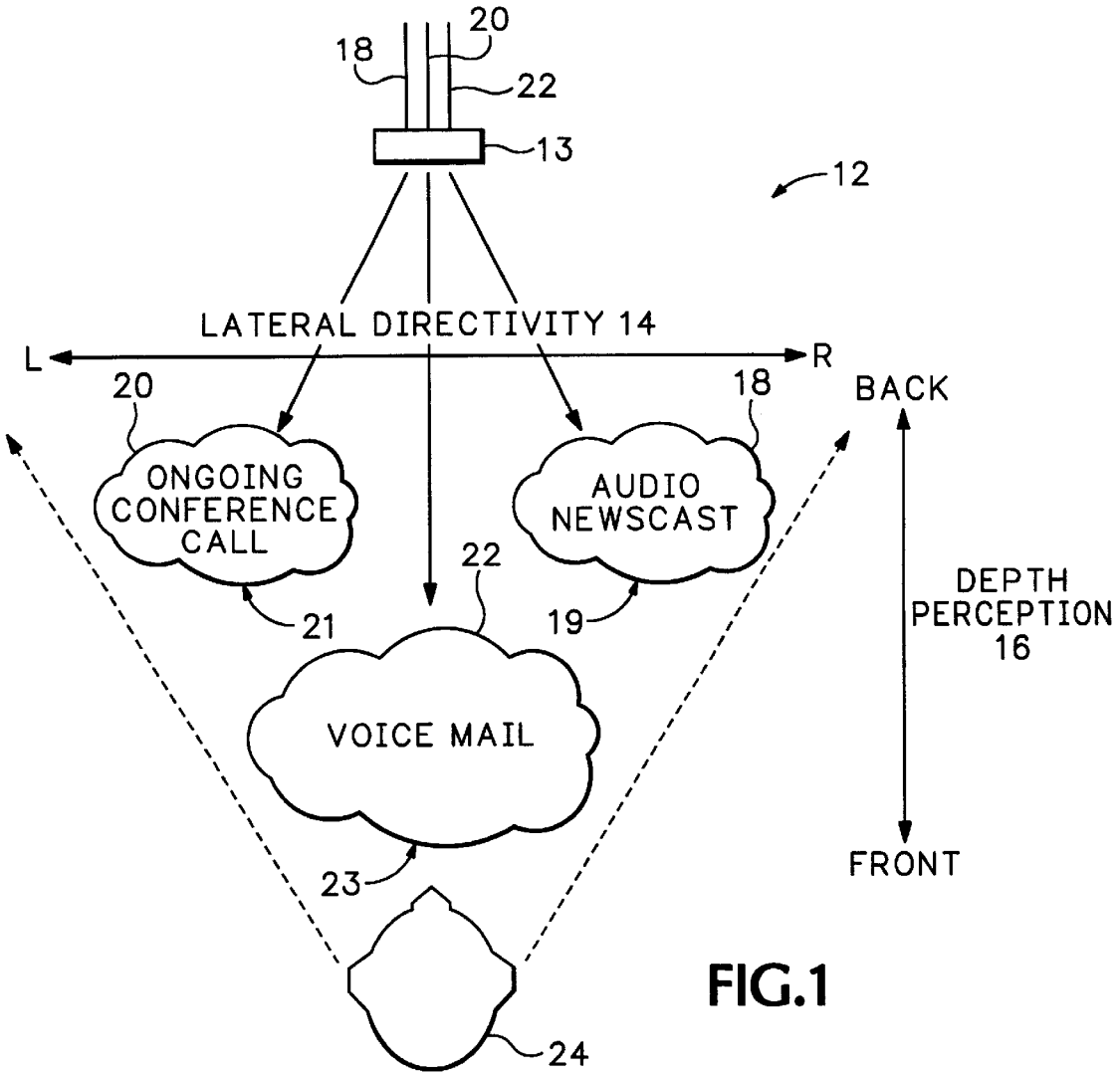
FIG. 1 is a schematic diagram of a user perception of incoming sound sources according to the invention.

Referring to FIG. 1, three incoming sound sources 18, 20 and 22 are each received at a common point source 13 then assigned and processed to be audibly perceived at different spatial locations 19, 21 and 23. The sound source 22 comprises a voice mail application that has been given foreground priority. The sound source 20 comprises an ongoing conference call application and the sound source 18 comprises an audio newscast. The conference call and the audio newscast each have been spatially processed to appear as peripheral and background point sources in relation to the voice mail application.

A listener 24 perceives each of the processed sound sources 18, 20 and 22 as coming from different spatial locations 19, 21, and 23, respectively. Since, the sound sources 18, 20 and 22 are spatially separated, the listener 24 can more easily focus on individual sound sources of auditory information in the presence of other sound sources. In other words, spatially separating the sound sources 18, 20 and 22 increases the ability of the listener 24 to differentiate between multiple sound sources.

Typically, independent sound sources are presented monaurally over telephone lines to a telephone set making it is difficult for the listener 24 to differentiate between the sound sources. For example, the listener 24 may wish to concentrate on one specific sound source containing the voice mail application while monitoring less important sound sources, such as the conference call application, in the background. By spatially locating the voice mail application in the foreground in front of the conference call application, the listener 24 can more effectively hear the voice mail messages while at the same time monitoring the conference in a less audibly distracting manner.

The different spatial characteristics are generally categorized into either "foreground" or "background" priority. The sound source for which the listener requires the highest degree of intelligibility is assigned to a "foreground" position located perceptually central and closest to the listener and given highest magnitude playback levels. Incoming sources of lower listening priority are assigned to one of several "background" positions, which perceptually are located behind and either to the left or right of the "foreground" position and given lower magnitude playback levels. Any one of the sound sources 18, 20 and 22 can be spatially located at any foreground or background depth 16 or any lateral direction 14.

There is no limit to the number of different foreground or background positions that can be created for different incoming sound sources. Human audio perceptual capabilities may limit the number of useful simultaneous foreground and background positions. For simplicity, further discussion of the specifics of the invention will describe three incoming sources and three spatial processing positions (front/center, back/left and back/right). However, the scope of the invention is not limited to a specific number of sources and/or spatial processing positions.

Figure 2:
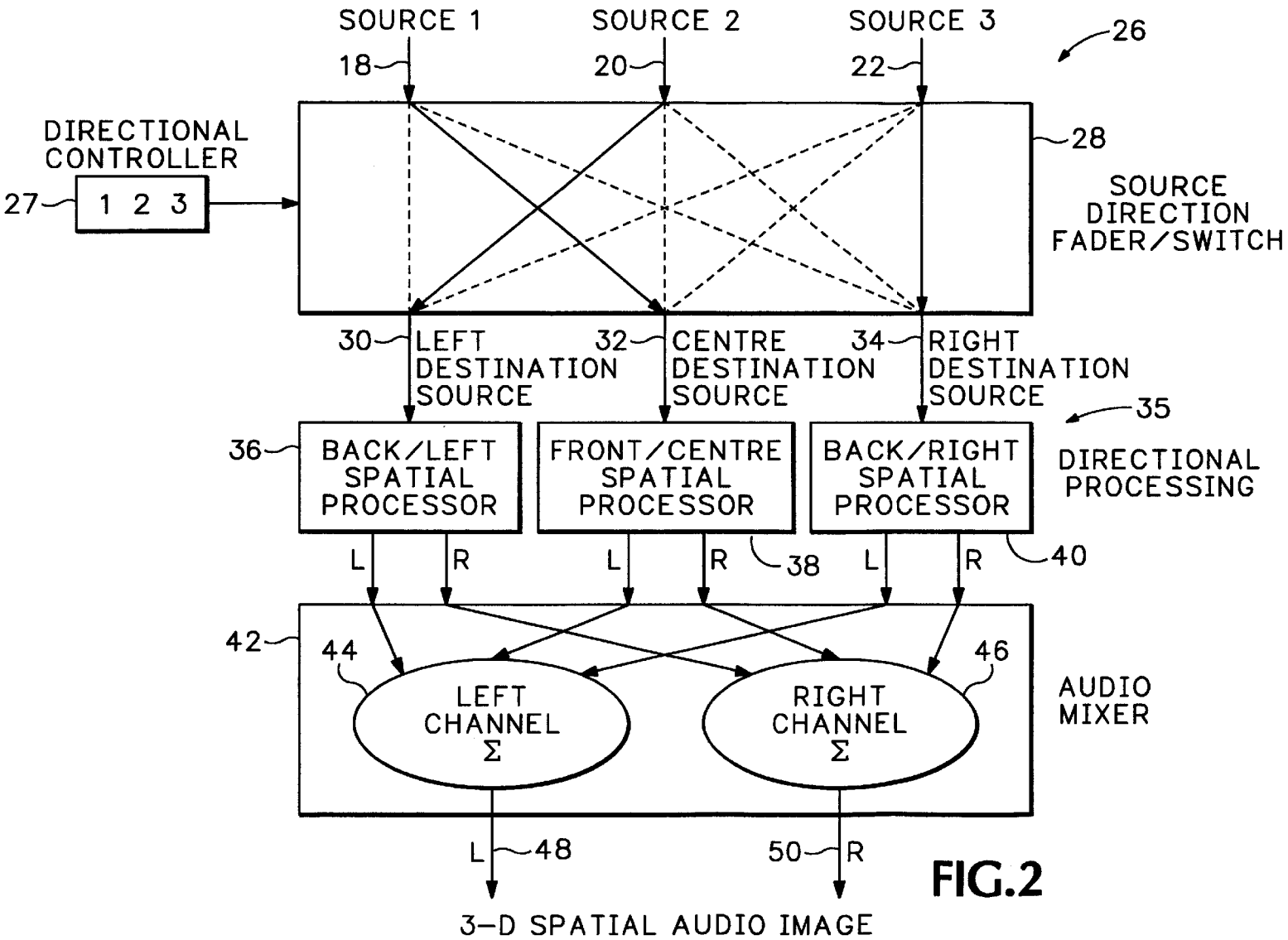
FIG. 2 is a block diagram of a spatial audio processor and context switching system according to the invention.

Referring to FIG. 2, the spatial audio processor and context switching system 26 includes a switching circuit 28 that controls the destination of each incoming sound source 18, 20 and 22. The switching circuit 28 is coupled to a controller 29 that selects which sound sources 18, 20 and 22 are mapped to which switch outputs 30, 32 and 34. The switching circuit 28 can incorporate conventional fader circuitry to control transitions and smooth subsequent positional changes of the sound sources 18, 20 and 22.

The volume for the first one of the multiple sound sources is automatically increased and volume for the other sound sources is automatically decreased. This crossfade operation may be accompanied by a shift in the pitch of the crossfaded channels according to the Doppler principle, or a sinusoidal signal varying in pitch according to the Doppler principle may be added to the crossfading channels to evoke the perception of moving sound sources.

Figures 3, 4:
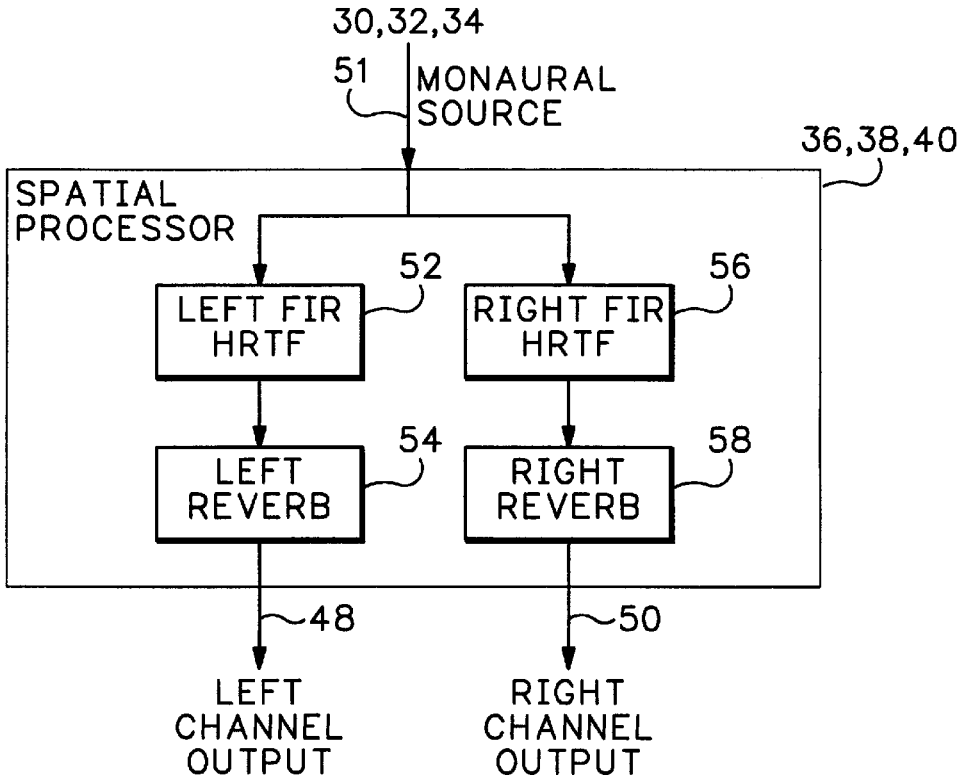
FIG. 3 is a table showing sample spatial selections for the spatial audio processor and context switching system shown in FIG. 2.
FIG. 4 is a detailed diagram of the spatial audio processor for the system shown in FIG. 2.

An example of control mapping for a three input channel switching circuit 28 are illustrated in FIG. 3. In a first position of controller 29, the first sound source 18 is connected to the back/left output 30, the second sound source 20 is connected to the front/center output 32 and the third sound source 22 is connected to the back/right output 34. In a second position for controller 29, the first sound source 18 is connected to the front/center output 32, the second sound source 20 is connected to the back/left output 30 and the third sound source 22 is connected to the back/right output 34. The third position of controller 29 directs the sound sources in a similar manner.

Referring back to FIG. 2, a directional processing circuit 35 applies a different monaural-to-stereo spatial process to each of the switched sound sources output from the switch circuit 28. The directional processor 35 includes different spatial processors 36, 38 and 40 connected to outputs 30, 32 and 34, respectively. Each spatial processor simulates a different spatial characteristic for the sound source on the connected output of switching circuit 28. For example, the sound source directed to switch output 30 is processed by spatial processor 36 to simulate a back/left spatial characteristic. The sound source directed to switch output 32 is processed by spatial processor 38 to simulate a front/center spatial characteristic, etc.

The spatial processors 36, 38 and 40 each generate a left channel signal and a right channel signal. An audio mixer 42 sums all left channel signal outputs from each of the stereo spatial processors 36, 38 and 40 into a single left channel output 48 and sums all right channel outputs into a single right channel output 50.

The spatial audio processor and context switching system 26 selectively switches incoming sound sources between desired foreground and background priorities. New audio applications may be subsequently launched with their associated audio paths assigned to any available incoming source stream for perceptual assignment to a new background or foreground location. In one implementation, audio processing is performed on digitally sampled 16-bit linear audio samples, with the resultant output also in 16-bit linear form. However, any other analog or digital processing implementation also comes within the scope of the invention.

The background point sources for any one of the multiple background sound sources is processed to be selectively audibly perceived as being behind, to either side, and above or below the sound source located in the foreground. Any one of the point sources is moveable to the left, right, above a zero degree elevation plane, below a zero degree elevation plane, to the foreground or to the background.

Referring to FIG. 4, each spatial processor 36, 38 and 40 includes a single monaural input 51 coupled to one of the outputs 30, 32 or 34 from the switching circuit 28. The received sound source is separated into a left channel and a right channel. The left channel includes a Finite Impulse Response (FIR) filter 52 that conducts a Head Related Transfer Function (HRTF) from a left direction. The right channel includes a FIR filter 56 that simulates HRTF from a right direction. The HRTF filters 52 and 56 simulate the acoustic path taken by the sound source from the assigned single point source to either the listener's left or right ear, respectively. The HRTF filters 52 and 56 together develop a stereo image from that single selected point source. The HRTF filters 52 and 56 are known to those skilled in the art and are therefore, not described in further detail.

Reverberation processors 54 and 58 are coupled to the left and right HRTF filter 52 and 56, respectively. The reverberation processors 54 and 58 add an additional sound energy decay characteristic to the filtered left and right signals. The sound energy decay characteristic simulates the natural diffuse decay of sound levels in a room due to multiple reflection paths but does not add any additional directional cues to the listener. Alternatively, a single reverberation circuit is coupled to a common input of both the left and right filters.

HRTF filtering and reverberation processing are described in detail in Massachusetts Institute of Technology Sound Media Archives located at http://sound.media.mit.edu/KEMAR.htm.; Durand R. Begault, 3-D Sound for Virtual Reality and Multimedia, Academic Press, Cambridge Mass., 1994; and J. M. Jot, Veronique Larcher, Olivier Warusfel, "Digital signal processing issues in the context of binaural and transaural stereophony", Proceedings of the Audio Engineering Society, 1995.

Figure 5:
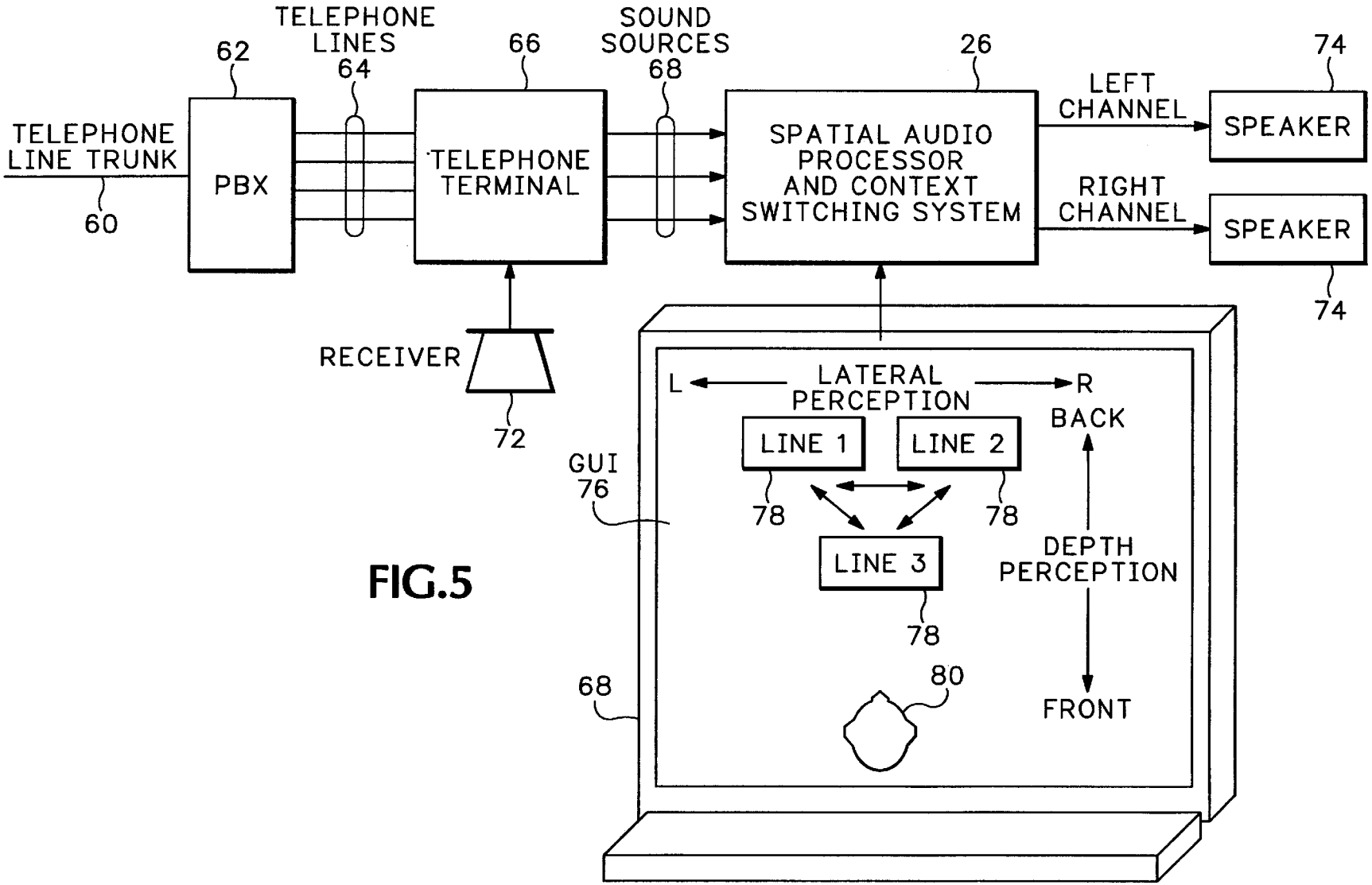
FIG. 5 is a schematic diagram showing a telephone system and a graphical user interface coupled to the system shown in FIG. 2.

Referring to FIG. 5, one possible application for the spatial audio processor is with a telephone PBX or LAN system. A telephone trunk 60 is coupled to a PBX 62 that connects different telephone lines 64 to a telephone terminal 66. A receiver 72 transmits user voice signals back through one or more of the telephone lines 64. The sound signals 68 received by telephone terminal 66 are output to the spatial audio processor and context switching system 26. A computer system 68 determines what spatial locations will be assigned to each active telephone line sound source before the sound sources are output from speakers 74.

According to the complexity and sophistication of the user's telephony device, a wide variety of switching mechanisms can be used to control the spatial audio processor and context switching system 26. Particular embodiments include button or switches 29, such as exist on a telephony set. FIG. 5 shows an alternative embodiment where logical controls are implemented through a graphical user interface (GUI) 76 on the computer 68. The GUI 76 can include screen-based buttons, sliders, or in the case of FIG. 5, icons 78.

The GUI 76 shows different spatial locations that can be simulated on the sound sources of three different telephone lines. The computer operator or listener manipulates the "auditory space" through the GUI 76 by explicitly positioning the icons 78 associated with each telephone line 1, 2 and 3 at different locations on the computer screen. Indirect or implicit control links audio foreground and background placement to the current "focus" of a particular audio application GUI window. For example, moving one of the icons 78 to the foreground automatically moves the associated sound source to the audio "foreground"(line 3) and pushes other incoming sound sources to background positions (lines 1 and 2).

If the user wishes to move either lines 1 or 2 to the foreground, the associated icon 78 is moved to the front and the remaining non-selected lines automatically move to the background. The sound source placed in the foreground is perceived by the listener as coming from a closer point source than the sound sources placed in the background.

In an alternative embodiment, the GUI includes a drawing of a conference table. The computer operator then moves the icons 78 to different positions around the conference table according to the priority given to each associated sound source. For example, an icon representing the telephone line of a supervisor may be located at the front of the table while icons representing telephone lines of subordinates may be located further back at the conference table.

Any type of control scheme can be used to control the sound sources. For example, the controller may be in the form of an application programmers interface (API) for a computer operating system or a computer telephony integration (CTI) that automatically switches for alarms or incoming messages. The CTI typically comprises an interface card that receives telephone calls on a computer terminal. As mentioned above, the controller can also be mechanical in the form of buttons, knobs, sliders, etc.

Thus, multiple audio streams are spatially separate with the spatial audio processor and context switching system 26 to differentiate a primary audio stream of interest from audio streams that are peripherally monitored. The listener can then more effectively focus on individual point sources of auditory information in the presence of other sound sources.

Having described and illustrated the principles of the invention in a preferred embodiment thereof, it should be apparent that the invention can be modified in arrangement and detail without departing from such principles. I claim all modifications and variation coming within the spirit and scope of the following claims.

We claim:

1. A system for context switching multiple sound sources, comprising:

a switching circuit receiving the multiple sound sources and selectively directing the sound sources according to associated telephony applications to different outputs each associated with predesignated different spatial destinations;

a directional processor system that applies different spatial characteristics to each of the sound sources output from the switching circuit, the spatial characteristics corresponding to the associated spatial destinations of the switching circuit outputs; and automatically moving one of the sound sources associated with a selected one of the telephony applications to a foreground audibly perceived point as one of said predesignated destinations while automatically moving sound sources for nonselected telephony applications to different background audibly perceived points as the other remaining predesignated destinations in relation to the foreground audibly perceived point thereby increasing and distinguishing the audible intelligibility for each of the sound sources for the selected telephony application from the sound sources for the nonselected telephony applications; and a controller coupled to the switching circuit that automatically configures the switching circuit to selectively directing the sound to said different outputs so that the sound sources for the selected telephony application move to the foreground while the sound sources for each of the remaining nonselected telephony applications automatically move to different background locations that have lower audible intelligibility than the selected telephony application.

2. A system according to claim 1 including an audio mixer coupled to the directional processor system that combines all the spatially processed sound sources into at least one common channel.

3. A system according to claim 1 wherein the directional processor system includes multiple spatial processors each coupled to an associated one of the switching circuit outputs.

4. A system according to claim 3 wherein each one of the spatial processors includes the following:

a left filter that simulates an acoustic path required to be taken by one of the sound sources to reach a left ear of a listener from the sound source associated spatial destinations; and a right filter that simulates an acoustic path required to be taken by one of the sound sources to reach a right ear of the listener from the sound source associated spatial destination.

5. A system according to claim 4 including a separately configurable left reverberation circuit coupled to the left filter and a separately configurable right reverberation circuit coupled to the right filter, or a single separately configurable reverberation circuit coupled to a common input of both the left and right filter for each one of the multiple spatial processors, the reverberation circuit or circuits simulating the natural diffusion decay of sound levels due to multiple sound reflection paths.

6. A system according to claim 1 including the following:

multiple telephone lines each carrying a separate one of the multiple sound sources;

a PBX coupled to a first end of the telephone lines; and a telephone terminal coupled between a second end of the telephone lines and the switching circuit and directing the sound sources for the same telephony applications to the same associated inputs of the switching circuit so that the sound sources for the same telephony applications are moved to the same audibly perceived point sources.

7. A system according to claim 1 wherein the controller comprises a graphical user interface including icons located on a screen that represent each one of the telephone applications, the graphical user interface automatically moving a selected one of the icons to a screen foreground position while automatically moving nonselected icons to screen background positions while the switching circuit moves the sound sources to perceived point sources corresponding with the icon screen positions.

8. A method for context switching multiple independent sound sources, comprising:

receiving the multiple sound sources at the same time;

selectively assigning the sound sources to different predesignated spatial destinations each representing different audibly perceived point source;

processing each of the multiple sound sources to simulate the different audibly perceived point source according to the assigned spatial destination;

selecting a switching position on a switching circuit that selects one of the multiple sound sources for increased audio intelligibility in relation to the other sound sources;

automatically reassigning the selected one of the multiple sound sources forward to a foreground spatial destination as one of said predesignated destinations with increased audible intelligibility in relation to the other spatial destinations;

automatically reassigning the nonselected ones of the multiple sound sources to unique background spatial destinations as the other remaining predesignated destinations both behind and to either side of the assigned spatial destination of the selected sound source;

outputting the sound sources to a listener thereby providing increased audibly intelligibility for the selected one of the multiple sound sources in relation to the remaining unselected sound sources;

selecting a different switching position on the switching circuit that selects a next one of the sound sources for increased audio intelligibility in relation to the other unselected multiple sound sources; and automatically moving the selected next one of the multiple sound sources forward to said foreground spatial destination while at the same time automatically moving all of the nonselected ones of the multiple sound sources to said background spatial destinations both behind and to either side of the selected next one of the multiple sound sources including automatically moving the sound source previously assigned to the foreground spatial destination backwards to one of said background spatial destinations both behind and to either side of the selected next one of the multiple sound sources.

9. A method according to claim 8 wherein processing the sound sources includes the following steps:

separating the sound sources into a left channel and a right channel;

filtering the left channel sound sources to simulate an acoustic path required to reach a left ear of a listener from the assigned spatial destinations; and filtering the right channel sound sources to simulate an acoustic path required to reach a right ear of a listener from the assigned spatial destinations.

10. A method according to claim 9 including individually reverberating both the filtered left and filtered right channel for each one of the sound sources to simulate the natural diffusion decay of sound levels due to multiple sound reflection paths.

11. A method according to claim 8 including crossfading the sound sources by automatically increasing volume for a first one of the multiple sound sources while automatically decreasing volume for the other sound sources.

12. A method according to claim 11 including shifting the pitch of the crossfaded sound sources according to a Doppler principle or a sinusoidal signal varying in pitch according to the Doppler principle to evoke the perception of moving sound sources.

13. A method according to claim 8 wherein processing the sound sources include simulating a center point source for a first one of the sound sources and simulating left or right point sources for the other multiple sound sources.

14. A method according to claim 8 wherein each of the multiple sound sources are received by monaural and carried concurrently and independently on separate telephone lines.

15. A method according to claim 8 including providing a computer with a graphical user interface and using the graphical user interface to selectively assign the sound sources to the different spatial destinations.

16. A method according to claim 15 wherein the graphical user interface includes multiple icons each representing one of the sound sources and automatically moving the sound source represented by a first selected one of the icons to a foreground point source and automatically moving sound sources for nonselected icons to background point sources.

17. A system for processing multiple independent monaurally transmitted sound streams, comprising:

a switching circuit for directing the multiple sound streams to different outputs each corresponding to predesignated spatial destinations;

a spatial processor including multiple filters each coupled to an associated one of the switching circuit outputs, the multiple filters simulating at the same time different spatial characteristics corresponding to said predesignated destinations on the sound streams from the switching circuit outputs;

an audio mixer coupled to the spatial processor for combining the different simulated sound streams together; and a controller including multiple switching positions for controlling how the switching circuit connects the sound streams to the filters in the spatial processor, so that one of the sound streams selected according to the controller switching position is automatically switched by the switching circuit to one of the multiple filters that move the selected sound stream to an audibly perceived point as one of said predesignated destinations with increased audible intelligibility in relation to the nonselected sound streams and at the same time the switching circuit automatically switching nonselected sound streams to filters that push back the nonselected sound streams to unique audibly perceived background locations as the other remaining designated destinations in relation to the selected sound stream.

* * * * *